US005484157A

United States Patent [19]

King

[11] Patent Number: 5,484,157

[45] Date of Patent: Jan. 16, 1996

[54] MILITARY CHESS GAME

[76] Inventor: Michael H. King, 2016 Paradise Point, York, S.C. 29745

[21] Appl. No.: 214,440

[22] Filed: Mar. 18, 1994

[51] Int. Cl.[6] ..... A63F 3/02

[52] U.S. Cl. ..... 273/260; 273/262

[58] Field of Search ..... 273/241, 242, 273/243, 260, 261, 255, 262

[56] References Cited

U.S. PATENT DOCUMENTS

| | | | |
|---|---|---|---|
| 186,181 | 1/1877 | Underwood | 273/262 X |
| 895,875 | 8/1908 | Mercer | 273/260 X |
| 1,141,909 | 6/1915 | D'Autremont | 273/260 |
| 1,307,871 | 6/1919 | Miller | 273/260 |
| 1,624,970 | 4/1927 | Owye | 273/260 |
| 1,877,154 | 9/1932 | Weaver | 273/260 X |
| 2,400,644 | 5/1946 | Hoffman | 273/262 X |
| 2,799,504 | 7/1957 | Keyko | 273/260 |
| 3,831,944 | 8/1974 | Upton | 273/262 |
| 4,015,849 | 4/1977 | MacLean | 273/260 X |
| 4,021,043 | 5/1977 | Lucero | 273/260 |
| 4,299,389 | 11/1981 | Miolo | 273/260 X |

FOREIGN PATENT DOCUMENTS

| | | | |
|---|---|---|---|
| 2191952 | 12/1987 | United Kingdom | 273/260 |

OTHER PUBLICATIONS

"Commander", *Playthings Magazine,* Jun. 1988, p. 75.

*Primary Examiner*—William E. Stoll

*Attorney, Agent, or Firm*—Clifton Ted Hunt

[57] ABSTRACT

This invention is a board game wherein the board has the same number of squares as a chess board and each player has sixteen movable pieces, as in chess. The movable pieces are military pieces simulating military personnel, armament, and a headquarters. The rules of chess apply except that the military pieces are enabled to move in a manner simulating movement of military equipment, which enables the players to combine military strategy with chess-like logic.

1 Claim, 2 Drawing Sheets

INITIAL SETUP

INITIAL SETUP - Figure 1

MILITARY CHESS GAME

FIELD OF THE INVENTION

This invention is a board game wherein the board has the same number of squares as a chess board and each player has sixteen movable pieces, as in chess. The movable pieces are military pieces simulating military personnel, armament, and a headquarters. The rules of chess apply except that the military pieces are enabled to move in a manner simulating movement of military equipment, which enables the players to combine military strategy with chess-like logic.

BACKGROUND OF THE INVENTION

THE GAME OF CHESS

Chess is a game of skill for two players. It is played on a square board divided into sixty four squares arranged in an eight-by-eight matrix, or in eight rows of eight squares each. The rows of squares are called ranks. Columns of squares are called files. The squares are alternately light and dark colors, commonly red and black. Each row has four light and four dark squares, with a light square at one end and a dark square at the other end.

Each chess player has sixteen movable pieces, namely, a king, a queen, two bishops two knights, two rooks or castles, and eight pawns. The movable chess pieces are typically white (or light) and black (or dark), corresponding to the light and dark squares on the board, and are arranged on the two horizontal rows of light and dark squares closest to each player.

Each player places the queen of that player's chosen or assigned color on the square of her own color nearest the center of the row closest to the player. The king is placed next to the queen on the other square nearest the center of the same row. The two bishops are placed on the same row and on the squares next to the king and the queen. The two knights are placed on the same row on the squares next to the bishops and the two rooks are placed at the ends of the same row, beside the knights. The eight pawns are placed on the eight squares of the next row.

According to the rules of chess:

(1) The king moves one square in any direction and can capture any opponent's piece, except the king, by moving into the square occupied by the other piece, except the king cannot move into a square where the king would be vulnerable to capture by an opponent's piece.

(2) The queen moves in a straight line on the rank, the file, or diagonally in any direction and for any distance over unoccupied squares. The queen cannot jump over pieces. The queen captures an opponent's piece, except the king, by moving into the square occupied by that piece.

(3) The bishops move diagonally over unoccupied squares for any distance. Thus, one bishop of each player may only move on dark squares and the other bishop may only move on light squares. Bishops capture an opponent's piece, except the king, by moving into a square occupied by that piece.

(4) The knights move in an L-shaped pattern, two squares in a straight line along a row or file and then one square at a right angle. A knights' move must end on a square the opposite color from the one on which it started. The knight is the only piece that may "jump" other pieces, but the piece over which a knight jumps is not affected by the jump. The knight captures an opponent's piece, except the king, by ending its move on the square occupied by that piece.

(5) The rooks move in a straight line for any distance. The rooks cannot jump or move diagonally. The rooks capture an opponent's piece, except the king, by moving into a square occupied by that piece.

(6) The pawns move one square forward (toward the opponent), except the initial move of each pawn may be either one square or two squares forward. A pawn must move diagonally forward one square to capture an opponent's piece, except the king, occupying that square. The pawn cannot move diagonally except to capture an opponent's piece, If a pawn advances to the eighth rank (the rank at the opposite side of the board), the pawn may be exchanged for a queen, rook, bishop or knight of the same color without regard to the number and type of pieces then on the board.

(7) Each chess player can perform a move called a "castle" once in the game, except when the king is in check, or if there are other pieces between the king and rook, or if the king or rook have been previously moved, or if the king or rook must pass over or land on a square occupied by an opponent's piece. "Castling" transposes a player's king and one rook. The king is moved two squares to its right or left on one row toward one rook and that one rook is moved over the king and placed on the square beside the king in the same row.

A king is "checked" when he is vulnerable to capture by an opponent's piece. The player "checking" an opponent's king must say "check". To avoid "checkmate", and the end of the game, a king in "check" must either move out of check, capture the attacking piece, or the defending player must move another piece between the king in "check" and the attacking piece. If none of those things can be done, then the king is "checkmated" and the game is over.

OTHER PRIOR ART

Games utilizing game boards with alternately colored squares and game pieces simulating military personnel and equipment have long been known.

U.S. Pat. No. 186,181 issued Jan. 9, 1877 to B. F. Underwood for GAME APPARATUS shows a game board with seventy two squares and ten game pieces for each of the two players. The pieces for each player include:

(a) a miniature foot soldier, representing infantry (six pieces), (b) a miniature horse and rider, representing cavalry (two pieces), and (c) a miniature cannon, representing artillery (two pieces).

The infantry moves one square in any direction; the cavalry moves three squares in any direct ion; and the artillery moves two squares in straight lines only. One player's pieces are light colored and the other player's pieces are dark colored.

Underwood's game board is different than the chess board and Underwood uses a different number of pieces than are used in chess.

U.S. Pat. No. 2,414,165 issued Jan. 14, 1947 to Guy Paschal for GAME PIECE shows a preferred game board with one hundred twenty one alternately colored squares. Paschal says the game can be played on a standard chess board with sixty four squares, "but the strategy of the game is cramped thereby" (column 6, lines 35, 36). The pieces for each player are miniature replicas of:

(a) an airplane carrier (one piece), (b) a transport vessel (one piece), (c) a battleships (one piece), (d) a destroyer (one piece), (e) a submarine (one piece), (f) an airplane (two pieces), (g) a torpedo (four pieces), and (h) a shell (five pieces).

The airplane carrier and the battleship are large enough to occupy two squares. The miniature ships are marked to indicate their armament and to indicate their vulnerability to being sunk by an opponent. The rules provide for the movement capabilities of the pieces.

Paschal's game board is preferably different than the chess board, and "the strategy of the game is cramped" if a chess board is used in playing Paschal's game. The rules of Paschal's game, concerning movement of the pieces and the vulnerability and striking power of the miniature ships, are different from and far more complicated than the rules of chess.

U.S. Pat. No. 2,400,644 issued May 21, 1946 to Hoffman for MILITARY CHESS GAME shows a game board with ninety six alternately colored squares, twelve along one side and eight squares along an adjacent side. Eighteen game pieces, miniature replicas of military personnel and equipment, are provided for each of the two players:

(a) infantrymen (eight pieces)

(b) anti-aircraft guns (two pieces)

(c) light tanks (two pieces)

(d) heavy tanks (two pieces)

(e) airplanes (two pieces)

(f) heavy artillery (two pieces)

Hoffman provides a "smokescreen" in the center of the board to prevent opposing players from observing the initial deployment of the enemy forces. The "smokescreen" is removed after the opposing forces have been deployed and the players alternately move their pieces according to the rules of Hoffman's game. The infantry pieces move the same as pawns in chess. All of Hoffman's other pieces move differently than chess pieces.

Hoffman's game board is different from the chess board, and Hoffman uses a different number of pieces than are used in playing chess.

The game chess and the three patents discussed above comprise the known prior art most pertinent to applicant's invention.

SUMMARY OF THE INVENTION

The invention is a game for two players using the same game board and the same number of playing pieces as in chess, but in a military environment on a camouflaged game board with game pieces (military pieces) that are miniature replicas of military personnel and equipment. The rules governing movement of the military pieces enable the players to simulate combat strategies that could be used in an actual ground battle, but cannot be carried out by following the traditional rules of chess.

The distinctive features of this invention combine with the traditional features of chess to enable the players to create unique offensive and defensive scenarios with military pieces that simulate aerial and ground military forces in the environment of a military engagement. Specifically, the rules governing movement of the military pieces enable players of the present game to combine military strategy with chess-like logic.

BRIEF DESCRIPTION OF THE DRAWINGS

FIG. 1 is a plan view of the game board, showing the initial position of the military pieces on the board;

DETAILED DESCRIPTION OF THE INVENTION

The military chess game is played by two players on a conventional chess board (battlefield) 10 with sixty four alternately colored squares. As in chess, the game board 10 has a main playing area defined by a square matrix of eight rows and eight files defining sixty four alternately colored playing squares, preferably dark green squares 11 and light tan squares 12, as in standard camouflage colors.

The object of the game is for each p layer to move the military pieces comprising their respective armies to strategic positions and/or protect their "headquarters" while trying to capture the enemy's military pieces and the enemy "headquarters" until Victory is achieved.

THE ARMIES

Figure 1A:
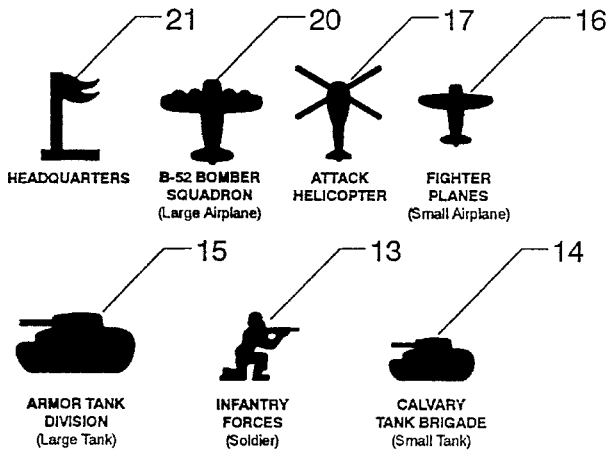
FIG. 1A is a designated illustration of each military piece.

Each player initially has an "army" comprising sixteen correspondingly colored military playing pieces, illustrated in FIGS. 1 1 and 1A and comprising:

(a) Six military pieces simulating a combat soldier, designated as "Infantry Forces" and indicated at 13 for the dark "army" and at 13A for the light "army" in FIG. 1. The movement capabilities of the infantry forces are shown FIGS. 2, 4, and 5.

Figure 3:
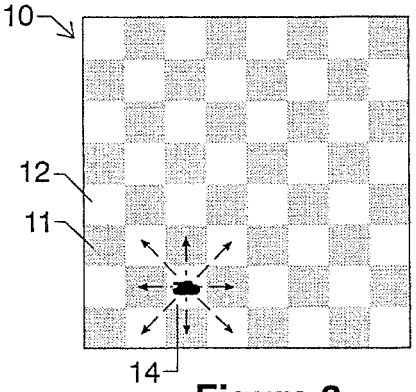
Figure 4:
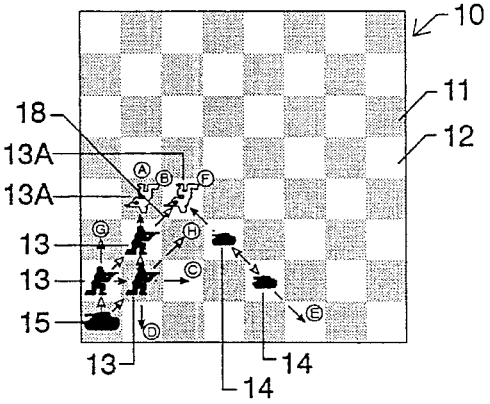
Figure 5:
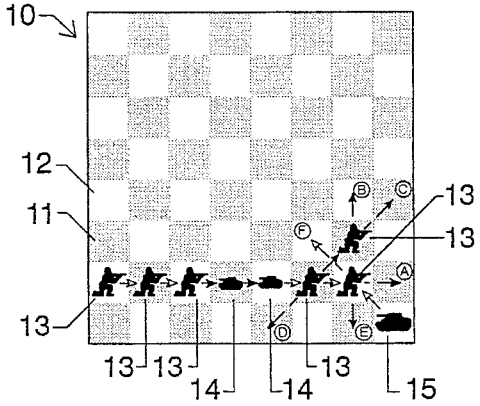

(b) Two military pieces simulating a small tank, designated "Calvary Tank Brigades" and indicated at 14 for the dark army and at 14A for the light army in FIG. 1. The movement capabilities of the cavalry tank brigades are shown in FIGS. 3, 4 and 5.

Figure 6:
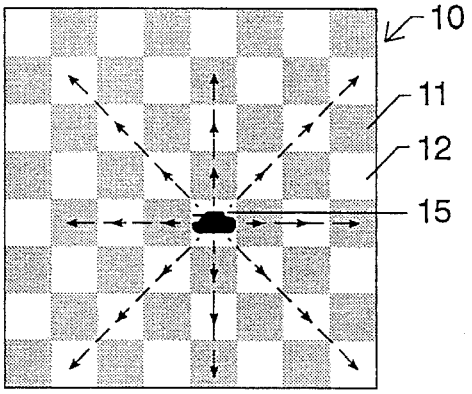

(c) Two military pieces simulating a large armored tank, designated "Armored Tanks" and indicated at 15 for the dark army and at 15A for the light army in FIG. 1. The movement capabilities of the armored tanks are as shown in FIGS. 4, 5, and 6.

Figure 7:
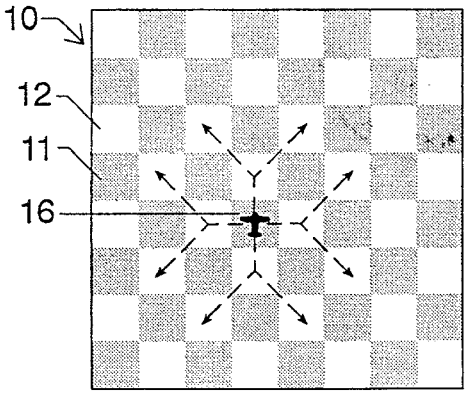

(d) Two military pieces simulating a fighter plane, designated "Fighter Planes" and indicated at 16 for the dark army and at 16A for the light army in FIG. 1. The movement capabilities of the fighter planes are shown in FIG. 7.

Figure 8:
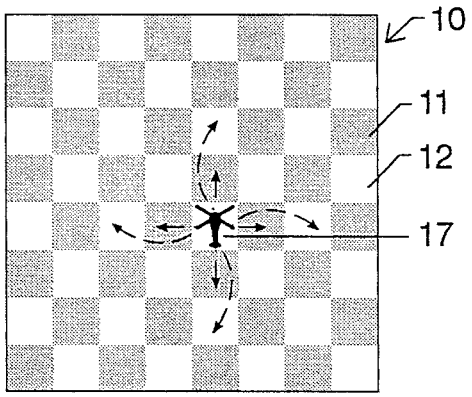

(e) Two military pieces simulating a helicopter, designated "Attack Helicopters", and indicated at 17 for the dark army and at 17A for the light army in FIG. 1. The movement capabilities of the helicopters is shown in FIG. 8.

Figure 9:
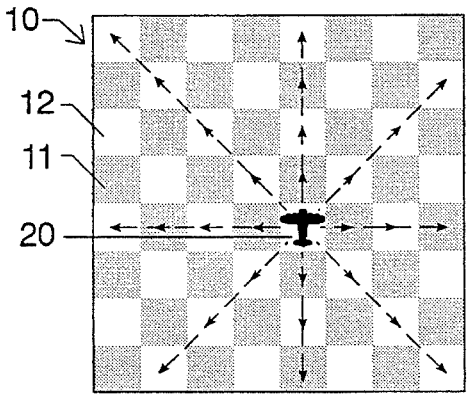

(f) One military piece simulating a bomber, designated "Bomber Plane", and indicated at 20 for the dark army and at and 20A for the light army in FIG. 1. The movement capabilities of the bomber are shown in FIG. 9.

Figure 10:
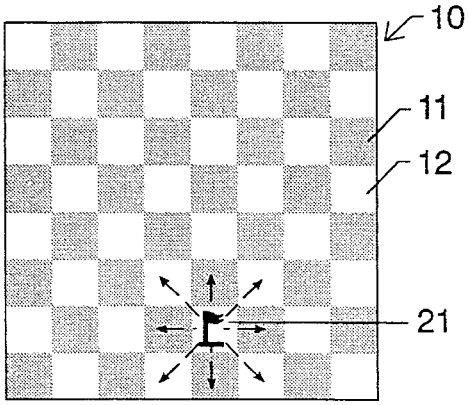

(g) One military piece simulating an army headquarters building, designated "Command Headquarters", and indicated at 21 for the dark army and at 21A for the light army in FIG. 1. The movement capabilities of the command headquarters is shown in FIG. 10.

The players move in alternating turns, as in standard chess, a piece or pieces in continuing efforts to capture enemy pieces while protecting their own. During a move, the moving piece may capture an enemy military piece by moving, in accordance with rules requiring limited movement, as illustrated in FIGS. 2 through 10, to a square occupied by the enemy's piece. The enemy piece is removed and the moving piece occupies that space.

Figure 2:
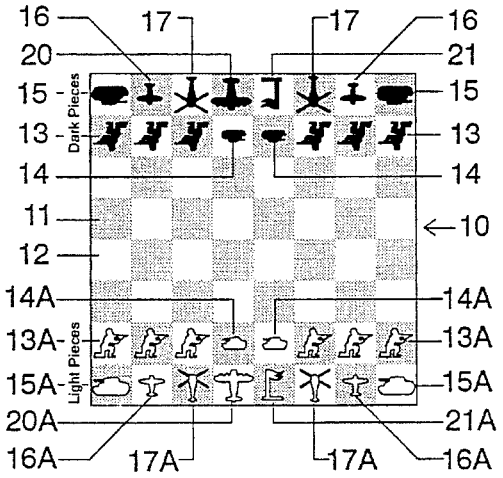
FIGS. 2–10 are plan views of the game board, each of which shows one of the military pieces and illustrates its capability of movement.
Figure 2:
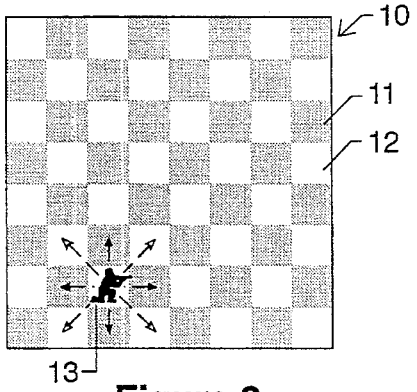

In FIGS. 2 through 10, a single dotted line with arrows illustrates rules requiring limited movement of each military piece. A solid arrowhead indicates moves with or without capturing an enemy piece. A hollow arrowheard indicates moves that can be made only without capturing an enemy piece. The moving piece can only move as shown by the dotted line to the space having the hollow arrowhead if that space is not occupied (FIGS. 2 and 4).

Each player of this military chess game has three military pieces with the same initial positions and subject to the same rules for movement as three of the pieces used by each player in the standard game of chess.

Two of those military pieces are the fighter planes 16 used by one player and the fighter planes 16A used by the other player of this military chess game. The fighter planes 16, 16A are initially positioned on the board like a chess player's knights are positioned on a chess board, and the fighter planes 16, 16A are subject to the same limited movements as are the knights in chess.

The command headquarters 21 of one player of this military chess game and the command headquarters 21A of his opponent represent the other military piece of this military chess game that occupies the same initial position and is subject to the same rules for movement as a chess piece used by each chess player in the standard game of chess. Each command headquarters initially occupies the same position on the game board as does one of the kings on a standard chess board and is subject to the same limited rules for movement as is the king in chess.

The color of the players' armies and the determination of which player moves first is decided by chance, such as the winner of a coin toss or throw of the dice.

The military pieces of each army are initially placed on the game board 10 with the light colored bomber 20A on the light colored square nearest the center of the first row of the light colored army, and with the dark colored bomber 20 starting on the dark colored square nearest the center of the first row of the dark colored army.

According to the rules governing the game of this invention, the infantry forces 13, 13A can move one square at a time, either forwardly or laterally or rearwardly or diagonally (FIG. 2).

The infantry forces 13, 13A can move diagonally one square at a time only if that diagonal square is unoccupied, as shown in FIGS. 4 and 5, but infantry forces 13, 13A do have the ability to participate with other infantry forces of the same color and with like-colored pieces of the cavalry tank brigades 14, 14A and the armored tanks 15 and 15A in blitz movements, as shown in FIGS. 4 and 5. Infantry forces can capture an enemy piece by moving forwardly, laterally, or rearwardly but, as shown in FIG. 2, infantry forces cannot capture an enemy piece by moving diagonally, as do pawns in the game of chess.

According to the rules of this military chess game, a blitz is a surprise coordinated movement by a group of two or more military pieces occupying consecutive squares that form a straight line in any direction. Only those military pieces representing infantry forces, cavalry tank and armored tank are recognized by the rules as having the ability to move together in a blitz that counts as one move.

The rules of the game provide that any piece of an army's infantry force that reaches the enemy's end of the game board can be substituted for any previously captured piece of the same color.

The rules governing the moves of the cavalry tank brigades 14, 14A are like those governing the moves of the infantry forces, with the important exception that the pieces of the cavalry tank brigades can move diagonally to capture an enemy piece, as shown in FIG. 4. Cavalry tank brigades 14 and 14A have the ability to participate with other cavalry tank brigade of the same color and with like-colored pieces of the infantry forces 13 and 13A and the armored tanks 15, 15A in blitz moves, as shown in FIGS. 4 and 5.

The rules governing movement of the armored tanks 15, 15A provide that the armored tanks can move:in any one direction, either forwardly, rearwardly, laterally, or diagonally, over any three unoccupied squares, and that the armored tanks 15, 15A have the ability to participate with other armore tanks of the same color and with like colored pieces of the infantry forces 13 and 13A and the cavalry tank brigades 14, 14A in blitz movements, as shown in FIGS. 4 and 5.

Each player has the option of making a blitz movement of one square in any direction when there is an alignment in any direction of two or more pieces of that player's infantry forces (I.F.), cavalry tank brigade (C.T.), or armored tank (A.T.). According to the game rules, only the front or leading I.F., C.T. or A.T. can capture an enemy piece that occupies the square on which a blitz movement ends.

The rules permit the player to choose how many properly aligned I.F., C.T., and/or A.T. pieces to move during a blitz. According to the rules, the pieces involved in a blitz follow behind a leading I.F., C.T., and/or A.T. The rules permit armored tanks to move in a blitz that moves either forwardly, rearwardly, or laterally, but the armored tanks can move only one square when moving as part of a blitz. According to the rules, an armored tank can move diagonally in a blitz if the diagonally adjoining square is not occupied, but armored tanks cannot capture any enemy piece during a diagonal blitz unless the blitz is led by I.F. or C.T.

The circled letters in FIGS. 4 and 5 are used in the printed rules for the game but are not presently relevant. In FIG. 4, two I.F. 13 attempt to blitz diagonally. The hollow arrowhead 18 signifies that the blitz is not possible because the square on which the blitz would end is occupied by an enemy piece and I.F. cannot capture an enemy piece when moving diagonally.

FIG. 4 also shows two I.F. 13 moving laterally and an I.F. and an A.T. moving diagonally in successful blitzes, although no enemy pieces are captured in either of these blitzes. Two diagonally aligned C.T.s 14 are shown to be successfully blitzing in both directions in FIG. 4, with the capture of an enemy I.F. 13A in the forward direction.

The blitz illustrated in the second row of the game board 10 in FIG. 5 shows five pieces:representing I.F. 13 and two pieces representing C.T. 14 properly aligned for a blitz to the second square in the second row, eighth file. One of those pieces 13 and another piece repesenting I.F. 13 are properly aligned for a blitz forwardly along the seventh file, and two pieces representing I.F. 13 are properly aligned for a blitz diagonally to the square in the fourth row, eighth file. A piece representing A.T. 15 and a piece representing I.F. 13 are properly aligned for a diagonal blitz to the square in the third row, sixth file.

The game rules for pieces representing fighter planes 16, 16A are the same as the rules for the movement of knights in a chess game. Pieces representing planes 16, 16A are allowed to move ("fly") over other pieces in an L-shaped pattern; two squares in a straight line along a row or file and then one square at a right angle, as shown in FIG. 7. The pieces representing planes 16, 16A always stop on a square of a different color than the square from which the move was started. Pieces representing planes 16, 16A can capture an enemy piece only if that enemy piece is located on the square occupied by the piece 16 or 16A at the completion of the move.

The game rules for the movement of pieces representing attack helicopters 17, 17A allow those pieces to also fly over other pieces. The pieces representing helicopters 17, 17A may move either one or two squares, as a player desires, along a row or file and can fly over an occupied square to capture-an enemy piece occupying the square on which the helicopter lands, as shown in FIG. 8.

The game rules for the initial position and movement of pieces representing bombers 20, 20A are the same as chess rules for the movement of the queen, except the game rules allow pieces representing bombers 20, 20A to move (fly) over pieces of the same color as the bomber, but pieces 20, 20A cannot fly over pieces of the opposite color. As shown in FIG. 9, the rules allow pieces representing bombers 20, 20A to move in any one direction over any number of unoccupied squares, and capture any piece of another color than the bomber by landing on the square occupied by a piece of another color. The rules do not allow pierces representing bombers 20, 20A to combine two directions in one move.

The game rules for the initial position and movement of pieces representing command headquarters 21, 21A are the same as chess rules for the king. The pieces representing headquarters 21, 21A can move and capture pieces of an opposing player by moving to any one adjoining square that is not dominated by an opposing piece.

THE OBJECT OF THE GAME

One object of the game is for the players to maneuver their pieces in such a manner that the piece representing the opponent's headquarters (21 or 21A) is vulnerable to capture. According to the game rules, the player (player A) successfully placing pieces to make an opponent's (player B) headquarters piece vulnerable to capture must declare "radar lock". Here, a headquarters piece 21 or 21A of player B that is under radar lock is in the same position as a king under check in a game of chess. Player B has an opportunity to get out of radar lock by either (1) moving the vulnerable headquarters piece to a square that is not vulnerable to attack by a piece of player A; or (2) moving to an adjoining square and capturing the piece belonging to player A that has placed the headquarters piece of player B under radar lock; or (3) player B can move one of his pieces to capture the attacking piece of player A or to block the enemy's attack.

If none of the above are possible, the game is over. The other player declares "Victory". The word "Victory" is the term used in the rules of this game to signify that one player has won the game.

The rules of this game provide that if both players are unable to move any of their pieces without putting their Headquarters under "Radar Lock", a "Truce" is called and the game is a "Draw". The game is also a "Draw" if neither player can capture the other's Headquarters. Or, the players can agree to end the game (battle) in a Draw.

The structure of the game board and the rules of the game have been deliberately patterned after chess to attract chess players to play this game without being confused by a whole set of new rules. Significant variations in the rules of chess have been made to adapt the logic of chess to a military environment. The result is a game that requires even more strategy than standard chess because the miniature military game pieces have movements that simulate the movements of the real military pieces represented by the miniature game pieces. All of the game pieces can move, attack, capture and/or retreat.

SIMULTANEOUS WARFARE

Figure 11:
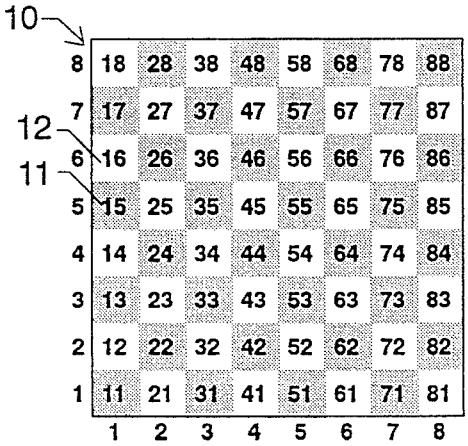
FIG. 11 is a plan view of an embodiment of the invention utilizing a numbered game board.

In another embodiment of the game, the game board 10 can be numbered as shown in FIG. 11, where each square has a double-digit number denoting the location of that square on the game board. For example, the square at the lower left of the game board has the double digits "11", indicating that the square is located in the first row, first file. Similarly, the square at the mid-portion of the game board 10, bearing the double digits "64". is located in the sixth row, fourth file.

This and other numbered game boards may be satisfactorily used to record the moves of the pieces during a game. The numbered game board shown in FIG. 11 has been found to be useful in playing Simultaneous Warfare, a variation of the military chess game of this invention.

The rules for Simultaneous Warfare call for two players using the numbered game board 10 shown in FIG. 11. The same game pieces shown in FIGS. 1 and 1A are used and the same rules are used in the game of Simultaneous Warfare as are used in the military chess game of the first embodiment of this invention, except that the players movements are made simultaneously, and not alternately, as in chess.

Instead, each player simultaneously makes a written notation of the move he is going to make. Then the players move their military game pieces on the numbered game board 10 in accordance with their written notations. Simultaneous movements of the military pieces likens the game to an actual battle where neither side knows the next move the enemy forces will make.

When both of the opposing players move one of their pieces to the same square, the highest ranking piece is allowed to make the move and capture the opposing piece, which is removed from the board.

If opposing pieces of the same rank reach a square at the same time, the successful movant is decided by chance, such as a flip of a coin or the roll of dice. The winner's piece makes the move and captures the loser's piece, which is removed from the board.

Simultaneous play continues until Radar Lock is achieved by one player. Thereafter, the players make alternate moves, as in the military chess game previously described until Victory is achieved or a Truce declared.

Although specific terms have been employed in describing the invention, they have been used in a descriptive and generic sense only and not for the purpose of limitation, the scope of the invention being determined by the appended claims when considered with this specification and the applicable prior art.

I claim:

1. A method for two players to play a game of military chess, said method comprising the steps of:

(a) providing a chess board with sixty four alternately colored light and dark squares, (b) providing sixteen game pieces for each player, (i) the game pieces of one player being distinguishable from the game pieces of the other player;

(ii) the sixteen game pieces for each player comprising six pieces representing infantry forces, two pieces representing a cavalry tank brigade, two pieces representing armored tanks, two pieces representing fighter planes, two pieces representing helicopters, one piece representing a bomber and one piece representing a headquarters;

(c) providing rules governing limited movement of the military pieces, wherein:

(i) the rules for movement of some of the military pieces are the same as the chess rules for movement of some of the game pieces in the game of chess and (ii) the rules for movement of other military pieces are different than the chess rules for movement of any of the game pieces in the game of chess;

(iii) "blitz" movements of one square may be made of any two or more pieces of infantry forces or special forces or armored tanks in a straight line of adjoining squares, whereby two or more of the game pieces may be moved in one game turn;

(d) placing the pieces of each player on the board so that the pieces for one player occupy the first two rows on one side of the board and the pieces for the other player occupy the first two rows on the opposite side of the board;

(e) the players moving in alternate turns one or more of the game pieces according to said rules governing the limited movement of the game pieces; and (f) continuing to move the pieces in alternate turns until the headquarters of one player has been placed under radar lock and the other player declares victory or until both players declare a truce or a draw.

* * * * *